United States Patent [19]

Ng et al.

[11] Patent Number: 4,725,867

[45] Date of Patent: Feb. 16, 1988

[54] APPARATUS FOR FORMING A MULTI-COLOR IMAGE ON AN ELECTROPHOTOGRAPHIC ELEMENT WHICH IS SENSITIVE TO LIGHT OUTSIDE THE VISIBLE SPECTRUM

[75] Inventors: Yee S. Ng, Fairport; Louis J. Rossi, Rochester; Domenic Santilli, Webster, all of N.Y.

[73] Assignee: Eastman Kodak Company, Rochester, N.Y.

[21] Appl. No.: 929,244

[22] Filed: Nov. 10, 1986

Related U.S. Application Data

[63] Continuation-in-part of Ser. No. 858,489, May 1, 1986, Pat. No. 4,654,282.

[51] Int. Cl.[4] ..... G03G 15/01

[52] U.S. Cl. ..... 355/4; 355/67; 355/77

[58] Field of Search ..... 355/77, 67, 4; 430/44, 430/43, 54, 97

[56] References Cited

U.S. PATENT DOCUMENTS

| | | | |
|---|---|---|---|
| 3,928,033 | 12/1975 | Anzai | 96/1.2 |
| 4,510,223 | 4/1985 | Kuehnle et al. | 430/44 |
| 4,645,330 | 2/1987 | Kohyama et al. | 355/4 |

FOREIGN PATENT DOCUMENTS

| | | | |
|---|---|---|---|
| 172659 | 9/1984 | Japan | 355/4 |
| 159767 | 8/1985 | Japan | 355/4 |
| 237467 | 11/1985 | Japan | 355/4 |
| 1035837 | 7/1966 | United Kingdom . | |

*Primary Examiner*—William H. Beha, Jr.
*Attorney, Agent, or Firm*—Robert L. Randall

[57] ABSTRACT

The invention provides electrophotographic apparatus for forming a subsequent toner image overlapping one or more toner images previously formed on a surface of an electrophotographic element.

The apparatus includes means for electrically charging the surface and the previously formed toner image or images, and means for forming an electrostatic latent image overlapping the previously formed toner image or images on the surface by imagewise exposing the element, through the previously formed toner image or images. The latent image forming means provides actinic radiation of a wavelength outside the range of 400 to 700 nanometers with the density of the previously formed toner image or images to the actinic radiation being less than about 0.2. The apparatus further includes means for electrographically developing the electrostatic latent image to thereby form the subsequent toner image.

10 Claims, 1 Drawing Figure

APPARATUS FOR FORMING A MULTI-COLOR IMAGE ON AN ELECTROPHOTOGRAPHIC ELEMENT WHICH IS SENSITIVE TO LIGHT OUTSIDE THE VISIBLE SPECTRUM

RELATED APPLICATIONS

This application is a continuation-in-part of U.S. Ser. No. 858,489, filed May 1, 1986, now U.S. Pat. No. 4,654,282, issued Mar. 31, 1987.

BACKGROUND OF THE INVENTION

1. Field of the Invention

This invention relates to electrophotographic apparatus for forming a plurality of overlapping toner images on a surface. More particularly, the method involves forming subsequent toner images overlapping previously formed toner images on an electrophotographic element, by imagewise exposing the element to actinic radiation that passes through the previously formed toner images without being significantly attenuated by those images.

2. Description of Related Art

In electrophotography an image comprising an electrostatic field pattern, usually of non-uniform strength (also referred to as an electrostatic latent image), is formed on an insulative surface of an electrophotographic element comprising a photoconductive layer and an electrically conductive substrate. The electrostatic latent image is usually formed by imagewise radiation-induced dissipation of the strength of portions of an electrostatic field of uniform strength previously formed on the insulative surface. Typically, the electrostatic latent image is then developed into a toner image by contacting the latent image with an electrographic developer. If desired, the latent image can be transferred to another surface before development.

When it is desired to use electrophotographic methods to form a composite image comprising a plurality of overlapping toner images ("overlapping" meaning lying, in whole or in part, over each other), e.g., to annotate a previous image record or to form a multi-color image record such as, for example, a multi-color proof, various alternatives are available.

One such alternative is to form separate single toner images on separate transparent supports and then overlay a plurality of these separate image-bearing supports, in proper registration, to form a multiple toner image. This is an involved process requiring careful registration with previous images, and, because each successive image is physically separated from previous images by at least one support, even when virtually perfect registration has been actually achieved, the images may appear to be out of registration, depending upon the angle of viewing and other factors.

Another alternative, which avoids supports between the images, involves electrophotographically forming a toner image singly and transferring the image to a receiving element while in proper registration with toner images previously sequentially formed and transferred to the receiving element. However, such a method requires that each successive toner image be kept in proper registration with previously transferred images during its transfer from the electrophotographic element to the receiving element. Maintaining such registration during toner transfer is an inherently slow and difficult process and is dependent upon virtually absolute dimensional stability of the electrophotographic element and the receiver element during each transfer step. It should be appreciated that it is difficult to prevent stretching, shrinkage, or other distortion of the elements while they are subjected to pressure, heat, or liquid contact during development or transfer. When such distortion occurs, registration is adversely affected.

Other methods are known, which do not require registration during toner transfer and, thus, avoid the problems inherent therein. For example, U.S. Pat. No. 3,928,033 and British Pat. No. 1,035,837 describe methods and apparatus for repetitively charging, exposing, and developing electrophotographic elements to form multiple overlapping toner images thereon. Each separate image is fixed in place before each succeeding cycle is carried out, and no transfer of toner images to a separate receiver element is intended; the electrophotograhpic element serves as the final image-bearing element. While problems of registration during transfer are thus avoided, there are other problems associated with such methods. The photoconductive layer of elements used in such methods significantly absorb visible light (since the actinic radiation employed in each imagewise exposure in those methods is visible light), and therefore, the photoconductive layers inherently impart an overall background tint or density to the final images when viewed. This can be very undesirable for some applications, e.g., where the intention is to produce a color proof to simulate intended press print quality and to allow evaluation of the color quality of original color separation negatives. Furthermore, in the methods of those two patents imagewise exposures subsequent to the first are carried out with actinic visible light that must pass through the previously deposited toner image or images before it can reach the photoconductive layer to produce selective charge dissipation. It should be appreciated that at some point in each of those methods the imagewise visible exposing light will either be undesirably attenuated by the previously deposited toner images (which are visibly colored and thus inherently block transmission of some visible light) thus causing false latent images to be created, or, alternatively, the previously deposited toner images will not in fact have been actually representative of the hues they were intended to represent. For example, in British Pat. No. 1,035,837 the order of imaging described is to produce cyan, then magenta, then black, and, finally, yellow toner images in overlapping configuration. in order to produce the yellow image, a visible actinic light exposure is intended to pass through the previous toner images, including the black image. No matter what the visible wavelength or wavelengths of that visible actinic light are, the light will either be undesirably attenuated nonuniformly by the black toner image to cause false imaging, or the black toner will not have been a true black as intended, since an image that truly appears black must inherently absorb light significantly throughout the visible spectrum (i.e., throughout the range of wavelengths from 400 to 700 nanometers). The same sort of problem is inherent in the disclosure of U.S. Pat. No. 3,928,033, wherein the order of imaging described is to produce yellow, then magenta, then cyan, and, finally, black toner images in overlapping configuration. The patent teaches use of white light in the final exposure step involved in producing the black toner image. It should be evident that each of the previously deposited yellow, magenta, and cyan toner images will undesirably attenuate that light nonuniformly on its way to the photoconductive layer and cause some degree of false imaging.

Another method, which also forms multiple overlapping toner images directly on an electrophotographic element, but which clearly avoids the problems inherent in the methods of the U.S. and British patents just discussed, is described in U.S. Pat. No. 4,600,669, the disclosure of which is hereby incorporated herein by reference. In the method of that patent an electrophotographic element is employed, wherein the electrically conductive substrate is transparent to the actinic exposing radiation intended to be used. The method requires that, at least after one toner image is formed on the front surface of the element, all further imagewise exposures are carried out through the transparent conductive substrate (i.e., through the rear surface of the element), rather than through the toner image previously formed on the front surface. Thus, no exposure is attempted to be carried out through previously formed toner images, and the potential problems thereof are completely avoided. However, such a method does require that a high-quality conductive substrate that is transparent and non-scattering to the actinic radiation be provided, which may in some cases be difficult or inefficient to accomplish, depending, for example, on the particular actinic radiation desired to be employed. It would be desirable to avoid the need for such a substrate.

U.S. Pat. No. 4,510,223 also describes a method and apparatus for forming a plurality of toner images in overlapping configuration on an electrophotographic element. The imaging exposures are carried out with a tungsten-filament visible light source equipped with a 480 nanometer broad band filter, the visible light of which is filtered imagewise through a different separation negative for each exposure. It is stated that sufficient exposures are made through previously formed toner images that do not adversely affect the latent image desired to be produced. The reasons for this are also stated. Previous toner images are formed in layers "thin enough to have a degree of transparency" to the exposing radiation. A large degree of transparency in such toner images is not necessary, since the intention is to produce half-tone images by completely discharging the photoconductor in each area exposed. Thus, the method uses an excess of visible exposing radiation overall in order to ensure that enough visible radiation will reach the photoconductor to completely discharge the exposed areas, even though the radiation may have been significantly attenuated by previously formed toner images in some areas. The patent teaches orders of multiple imaging, wherein the first toner image formed is always a black toner image. Of course, the amount of visible radiant energy that is sufficient to punch through a partially transparent toner in some areas (e.g., a black toner) and completely discharge the photoconductor in those areas, is much more than enough to effect such complete discharge in areas having no previously formed toner. Thus, while such a method may avoid false imaging due to previous toner images, it does so by wasting energy through overexposure of untoned areas; and the method cannot be used to form continuous-tone images that depend on gradations of toner deposition height, rather than area coverage, to give visual impressions of differing degrees of visual density, because the only possible results of the method are no toner image dots (in areas of no discharge because of no exposure) or maximum density toner image dots (in areas of complete discharge because of high exposure).

It would be desirable to provide apparatus for electrophotographically forming a plurality of overlapping toner images, wherein imagewise exposures are carried out through previously formed toner images without adverse attenuation of the actinic exposing radiation and without wasing energy by overexposure, and wherein the apparatus can be used to provide continuous-tone or half-tone images, as desired. The present invention provides such an apparatus.

SUMMARY OF THE INVENTION

The invention provides an electrophotographic apparatus for forming a subsequent toner image overlapping one or more toner images previously formed on a surface of an electrophotographic element, with the apparatus comprising:

(a) means for electrically charging the surface and the previously formed toner image or images, (b) means for forming an electrostatic latent image overlapping the previously formed toner image or images on the surface by imagewise exposing the element, through the previously formed toner image or images, to actinic radiation of a wavelength outside the range of 400 to 700 nanometers; the density of the previously formed toner image or images to the actinic radiation being less than about 0.2, and (c) means for electrographically developing the electrostatic latent image to thereby form the subsequent toner image.

Further, the invention provides means for utilizing actinic radiation of a wavelength outside the visible spectrum, wherein the previously formed toner images have a density of less than 0.2 to the actinic radiation. Thus, there is no adverse significant attenuation of the actinic exposing radiation by previously formed toner images and no need to waste energy through overexposure of previously untoned surface areas. Also, since the actinic radiation can be modulated in accordance with the visual density pattern of the image desired to be produced without any significant interference from previously formed toner images, the method can serve equally as well to produce continuous tone or halftone images.

Moreover, the present invention provides an electrophotographic apparatus for forming a composite toner image on a surface of a charged electrophotographic element which is sensitive to a predetermined wavelength of actinic radiation outside the visible spectrum and wherein said toner image is formed of preselected toner materials having a density of less than 0.2 to such actinic radiation. The apparatus comprises means for providing relative motion between the electrophotographic element and successive charging, exposing, and developing stations, means at the charging station for electrically charging the electrophotographic element, means at the exposure station for generating actinic radiation having the predetermined wavelength to expose the electrophotographic element to form an electrostatic latent image on the electrophotographic element, means at the developing station for developing the electrostatic latent image with one of the preselected toner materials, and means for repeating the relative motion between the electrophotographic element bearing a developed image and the stations for charging and exposing the electrophotographic element through the developed image to form an additional latent electrostatic image on the electrophotographic element and for developing the additional image using another of the preselected toner materials to produce a composite image formed of at least two toner materials on the electrophotographic element.

As long as the toners have insignificant density to the actinic radiation (i.e., a density less than about 0.2), they can be chosen and deposited to accurately represent the visible hues and gradations of visible density of any visible image desired to be produced or reproduced. Thus, toner images having significant visible density (i.e., density of about 0.2 or greater) at any or all wavelengths in the visible spectrum can be accurately fashioned and can be electrophotographically overlapped by equally accurate subsequent toner images, since subsequent imagewise actinic exposures will not be significantly non-uniformly attenuated thereby and will not produce false latent images.

In some embodiments of the invention an electrophotographic element is employed wherein the surface to be charged, exposed, and toned is the outer surface of a dielectric support releasably adhered to a photoconductive layer which is on an electrically conductive substrate. This enables the overlapping toner images to be completely transferred to a receiving element of choice (e.g., to paper chosen to simulate or be the same as printing press paper, or to transparent film in order to provide a transparent image record) by contacting the surface of the dielectric support, having the overlapping toner images thereon, with a receiving element and transferring the dielectric support and overlapping toner images to the receiving element to form an image record wherein the overlapping toner images are sandwiched between the dielectric support and the receiving element. Such an image record is also protected from abrasion or other image degradation that might otherwise be caused by contact with surrounding atmosphere or other external materials.

The apparatus can be particularly advantageously employed to form color proofs, wherein each toner material can be chosen to provide a color accurately representative of an ultimate press run color, without interfering with subsequent electrostatic latent image formation.

Various means for practicing the invention and other features and advantages thereof will be apparent from the following detailed description of the preferred embodiment of the invention, reference being made to the accompanying drawing.

DESCRIPTION OF A PREFERRED EMBODIMENT

Figure 1:
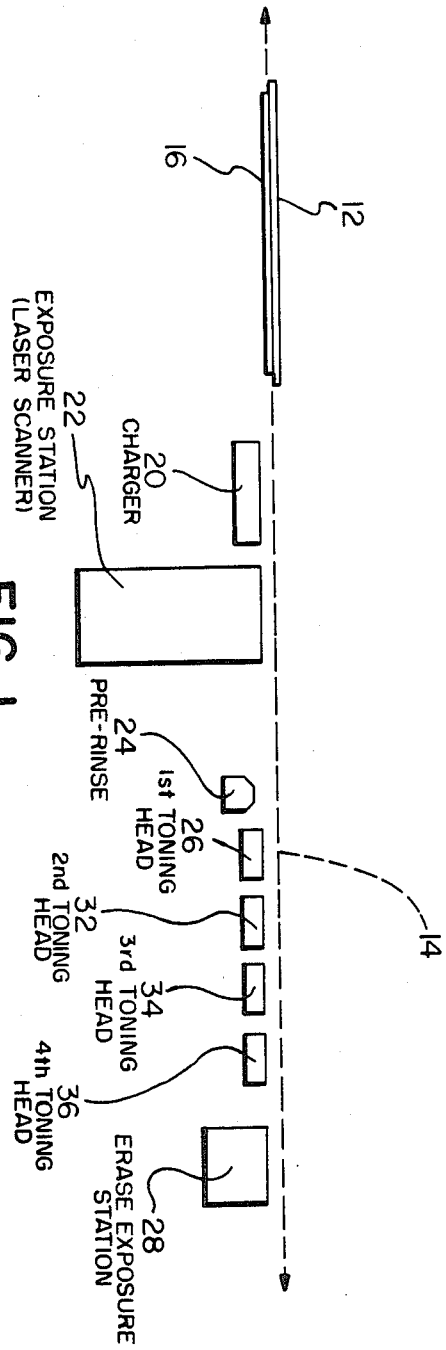
FIG. 1 is a schematic illustration of electrophotographic apparatus for forming a multi-color image according to the present invention.

Although the present invention is applicable to various electrophotographic elements, methods and apparatus, the embodiment to be described is directed to a multi-color electrophotographic image-producing apparatus employing an electrophotographic element of the type disclosed in U.S. Pat. No. 4,600,669. Other electrophotographic elements useful in the apparatus of the invention are any of the known types of such elements, with the sole additional proviso that the photoconductive element be chosen, or be modified with sensitizing additives, to be sensitive to the particular actinic radiation of choice having significant intensity at a wavelength outside of the visible spectrum (i.e., a wavelength outside the range of 400 to 700 nanometers).

A schematic illustration of a multi-color electrophotographic image processor is illustrated in FIG. 1 and consists of a means for providing relative motion between the electrophotographic element and successive charging, exposing, and developing stations. The relative motion providing means comprises a carrier or platen 12 which is movable along the processing path, generally represented by dotted line 14, past the respective processing stations of the apparatus, to be described hereinafter. The path 14 may be determined by guide-rails or other structure of the apparatus in a manner well-known in the art whereby the platen may move from a first position, illustrated, to the rightmost position and then return to the left to the starting position. The platen 12 is provided with means, not shown, for retaining an electrophotographic element 16 on the lower surface thereof.

As noted in the above-identified copending application, the electrophotographic element comprises a photoconductive layer on an electrically conducting substrate. A dielectric support is releasably adhered to the substrate and either comprises the photoconductive layer or an overcoat thereof which forms an outer surface of the element capable of holding an electrostatic charge. To use the element, the surface of the dielectric support is charged and the photoconductive layer is subsequently imagewise exposed to the actinic radiation, thereby forming a developable electrostatic latent image on the dielectric surface. The latent image in turn is developed with one of the preselected toners to form a first color image and a composite color image can be formed on the element by repeating this sequence one or more times with successive imagewise exposure of the photoconductive layer through the previously deposited toner images to actinic radiation transmitted through the toner images, and developing over each preceding image with a different preselected toner, preferably having a different color. The composite toned image is then transferred with the dielectric support to a receiving element to form a color copy which may be a color proof closely simulating the color print expected from a color print press.

Accordingly, the electrophotographic element 16 is mounted onto the platen 12. The element may be held to the platen by any suitable means known in the art, such as a vacuum clamp. Further, the electrophotographic element must also be suitably grounded to the apparatus to enable the charging process to be satisfactorily carried out. A number of grounding means are known in the art and will not be described herein. As the platen 12, with the electrophotographic element 16 thereon, is translated to the right, the dielectric support is given an overall charge via a charging means 20, such as a corona charger, known in the art, to form a uniform potential on the surface of the dielectric support. Upon being so charged, the electrophotographic element is imagewise exposed by passing through an exposure station 22 which projects actinic radiation having a preselected wavelength outside of the visible spectrum to produce an imagewise exposure in the electrophotographic element. This actinic radiation has the same preselected wavelength as that to which the electrophotographic element is sensitive. In the preferred embodiment, the exposure station comprises means, such as a laser, for generating a raster that can be provided with image-containing information to generate a latent image in the electrophotographic element, in a manner well-known in the art.

The platen then continues its movement, still to the right, passing over a pre-rinse head 24 which is fixed in position whereby the fluid head provided thereat when activated contacts the lower surface of the electrophotographic element as it passes in the processing direction, i.e. to the right, but does not contact the element when the fluid head is inactivated as when the platen is moved to the left to the original position. The pre-rinse head pre-wets the element with a dispersant dielectric liquid prior to the liquid toning step. Thereafter, the platen moves past a raised first liquid toning station 26 which is raised into operating position whereby the lower surface of the electrophotographic element is contacted and the toner image is imparted thereto, in a manner well-known in the art. In this system, the liquid toner is deposited in the unexposed, still charged area of the electrophotographic element thereby forming an image. The platen continues movement to the right in the illustration past appropriate rinse heads and dryers, not shown. The last station at the right end of the apparatus is an erase lamp that exposes the electrophotographic element after the toning operation to expose those parts of the photoconductor layer that were not exposed by the original image exposure so that the entire electrophotographic element has substantially the same exposure history. The platen is then reversed and returned to the first position illustrated and the platen is again moved to the right to repeat the relative motion between the electrophotographic element bearing the developed image and the stations for charging, exposure and subsequent toning with a subsequent image. This time the exposure station, by utilizing a light source generating actinic radiation having the preselected wavelength outside of the visible spectrum and corresponding to the wavelengths at which the toner materials have a density of less than 0.2, exposes the next image onto the electrophotographic element through the previously applied developed toner image. Control means, of a type well-known in the art, is provided to control the operation of the apparatus, to actuate the desired stations, and to control the movement of the platen, etc.

Thereafter, the platen again moves the electrophotographic element to the pre-rinse station and then to a second toning station 32 which is in operative position to tone the surface of the electrophotographic element with a second color toner to produce a second color visible image overlying the first image. The platen subsequently moves past the aforementioned rinse and drying stations and again past the erase exposure station 28 before being returned to the first position at the lefthand end of the apparatus. Should it be desired to create a four color image (or a three color plus black image), the charging, exposing, and toning steps will be repeated for two more exposures with the platen and electrophotographic element being moved into operating contact with an additional two toning stations 34 and 36, one for each of the additional colors. It will be appreciated that, as well-known in the art, the toning order may not necessarily be represented by the physical order of the toning stations in the apparatus, and the order given above is by way of example only.

Electrophotographic elements having particularly advantageous utility are those containing a strippable dielectric support and are described, for example, in the above-identified U.S. Pat. No. 4,600,669 (which has been incorporated by reference), with the exception that there is no need to limit the choice of electrically conductive substrates to those that are transparent to the actinic radiation of choice (since imaging exposures are not carried out through the conductive substrate in the present method), and with the proviso that the choice of photoconductive materials must be coordinated with the choice of a particular actinic radiation to be employed.

In some preferred embodiments of the method of the invention the wavelength of actinic radiation falls in the near-infrared region of the spectrum, i.e., in the range from greater than 700 nanometers to less than or equal to 1000 nanometers. Photoconductive layers having sensitivity to near-infrared radiation are well known in the art. See, for example, U.S. Pat. Nos. 4,337,305; 4,418,135; and 3,793,313.

In some particularly preferred embodiments the wavelength of actinic radiation is about 830 nm, and the photoconductive layer of the electrophotographic element contains as a photoconductor either a compound having the structure:

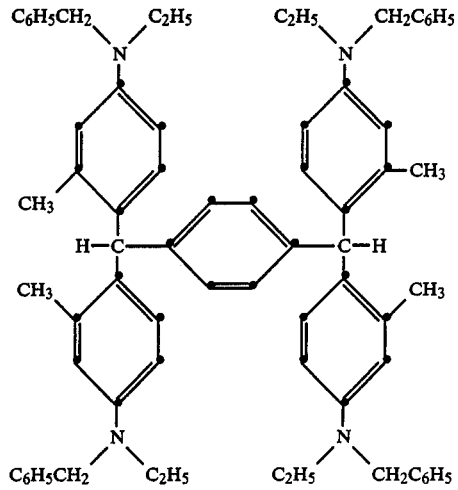

I or a compound having the structure:

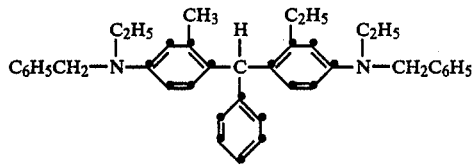

II and also contains a near-infrared sensitizer comprising 2-(2-(2-chloro-3-(2-(1-methyl-3,3-dimethyl-5-nitro-3H-indol-2-ylidene)ethylidene)-1-cyclohexen-1-yl)ethenyl)-1-methyl-3,3-dimethyl-5-nitro-3H-indolium hexafluorophosphate.

Electrographic developers useful in the method of the invention are any of the known types of such developers (such as single component dry developers comprising particulate toner material, dual component dry developers comprising particulate toner material and particulate carrier material, and liquid developers comprising particulate toner material dispersed in a liquid carrier medium), with the proviso that any developer material that remains on the electrophotographic element after development in other than the last development step (usually toner binder material and toner colorant) have insignificant density (i.e., density less than about 0.2) to the particular actinic radiation of choice that has significant intensity at a wavelength outside of the visible spectrum. As mentioned previously, in some preferred embodiments of the method of the invention the wavelength of actinic radiation falls in the near-infrared region of the spectrum.

Many known toner binder materials have insignificant density to near-infrared radiation and are thus useful in such embodiments. One class of such useful binders comprises polyesters comprising recurring diol-derived units and recurring diacid-derived units, e.g., polyester binders having one or more aliphatic, alicyclic or aromatic dicarboxylic acid-derived recurring units, and recurring diol-derived units of the formula:

$$-O-G^1-O- \qquad \text{III}$$

wherein:

$G^1$ represents straight- or branched-chain alkylene having about 2 to 12 carbon atoms or cycloalkylene, cycloakylenebis(oxyalkylene) or cycloalkylenedialkylene.

Especially preferred polyesters are those which have up to 35 mole percent (based on the total moles of diacid units) of ionic diacid-derived units of the structure:

$$-\overset{O}{\overset{\|}{C}}-A-\overset{O}{\overset{\|}{C}}- \qquad \text{IV}$$

wherein:

A represents sulfoarylene, sulfoaryloxyarylene, sulfocycloalkylene, arylsulfonyliminosulfonylarylene, iminobis(sulfonylarylene), sulfoaryloxysulfonylarylene and sulfoaralkylarylene or the alkali metal or ammonium salts thereof. The diol- or diacid-derived units set forth above can be unsubstituted or substituted as desired.

Such preferred polyester resins include, for example, the polyester ionomer resins disclosed in U.S. Pat. No. 4,202,785 and the linear polyesters described in U.S. Pat. No. 4,052,325, the disclosures of which are hereby incorporated herein by reference.

Other useful toner binder resins include acrylic binder resins (e.g., as disclosed in U.S. Pat. Nos. 3,788,995 and 3,849,165), other vinyl resins, styrene resins, and many others well known in the art.

Many known toner colorant materials (dyes or pigments) have insignificant density to near-infrared radiation and are thus useful in some preferred embodiments of the method of the invention. It will be appreciated that most yellow and magenta colorants and many cyan colorants, chosen to have peak densities within the visible spectrum, will have insignificant density to near-infrared radiation. The choice of an appropriate black toner colorant, however, presents a bit more difficulty, since most known black colorants, (e.g., the carbon black colorants) also have significant density to near-infrared radiation.

Fortunately, a class of black colorants has been unexpectedly found to serve as good toner colorants yielding a truly black appearance, yet having insignificant density to near-infrared radiation. Such black colorants have the structure:

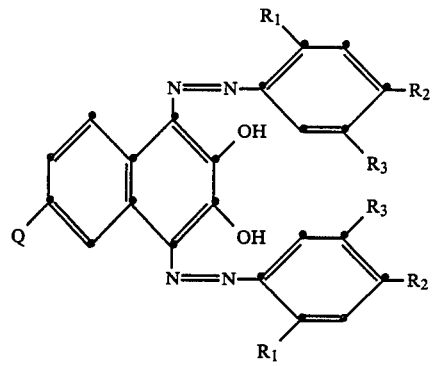

V wherein

Q is H or $-SO_3M$, wherein M is $NH_4$ or an alkali metal;

$R_1$ is H or alkoxy having 1 to 4 carbon atoms;

$R_2$ is H, $-OCH_2CONH_2$, or alkoxy having 1 to 4 carbon atoms;

$R_3$ is H, $-NO_2$, or $-SO_2NHR_4$ wherein $R_4$ is H, alkyl having 1 to 4 carbon atoms, phenyl, naphthyl, or alkyl-substituted phenyl or naphthyl wherein the alkyl has 1 to 4 carbon atoms. Black colorants of this type and their preparation are described in U.S. Pat. Nos. 4,414,152 and 4,145,299. Specific examples of such useful black colorants are those wherein:

each of Q, $R_2$, and $R_3$ is H, and $R_1$ is $-OCH_3$;

each of $R_2$ and $R_3$ is H, Q is $-SO_3Na$, and $R_1$ is $-OCH_3$;

each of Q,, $R_1$, and $R_3$ is H, and $R_2$ is $-OCH_3$;

each of Q, $R_1$ and $R_3$ is H, and $R_2$ is $-OCH_2CONH_2$;

each of Q and $R_2$ is H, $R_1$ is $-OCH_3$, and $R_3$ is $-SO_2NH_2$;

each of Q and $R_2$ is H, $R_1$ is $OCH_3$, and $R_3$ is $-NO_2$; or

Each of Q, $R_1$ and $R_2$ is H, and $R_3$ is $-NO_2$.

In some particularly preferred embodiments of the method of the invention the wavelength of actinic radiation is about 830 nm. Specific examples of useful toner colorants having less than about 0.2 density to 830 nm radiation are:

the cyan colorant having the structure

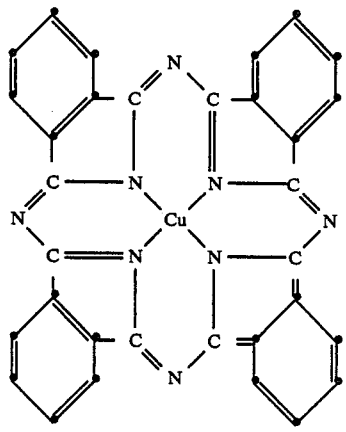

VI (available from Sun Chemical Co., USA);

the magenta colorant having the structure:

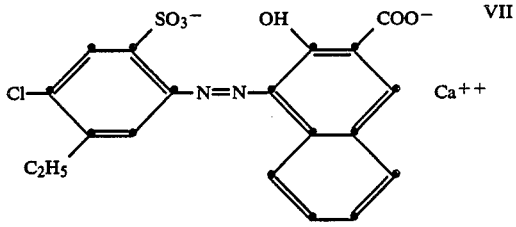

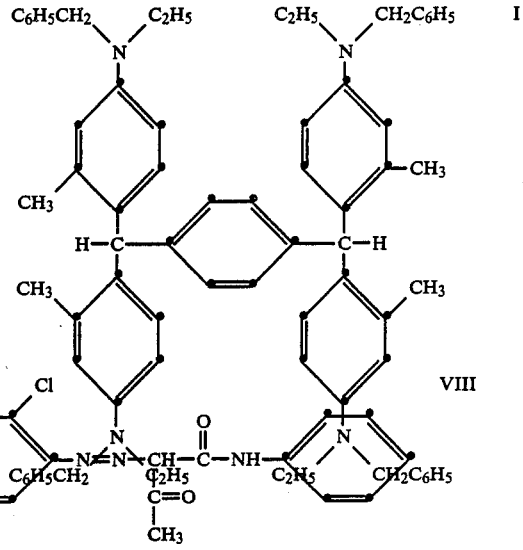

which is also available from Sun Chemical Co.;

the yellow colorant having the structure:

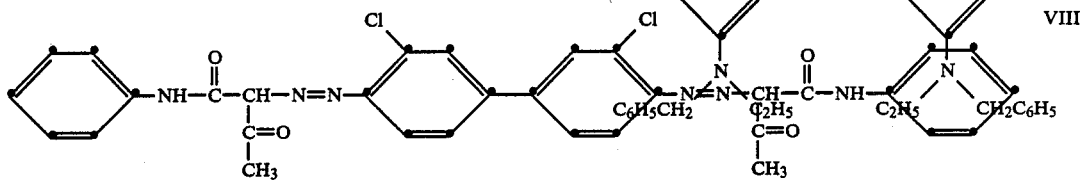

(available from the Hoechst Chemical Co. and the Sherwin Williams Co.); and the black colorants described above, especially 1,4-bis(o-anisylazo)-2,3-naphthalenediol.

In preferred embodiments of the method of the invention, wherein the actinic radiation is near-infrared radiation, such radiation can be provided, for example, by filtering a wide-spectrum radiation source to allow only the near-infrared portion through, or by initially creating radiation having only near-infrared components, e.g., by means of a laser diode. In particularly preferred embodiments, wherein 830 nm radiation is used, such radiation can be easily provided by an AlGaAs laser diode, widely available from many sources.

In carrying out imagewise exposures in the method of the invention while using, for example, a laser diode near-infrared radiation source in a laser scanning apparatus (of which many are known; see, for example, copending U.S. patent application Ser. No. 848,427, filed Apr. 4, 1986, the disclosure of which is hereby incorporated herein by reference), the actinic radiation can be easily modulated imagewise by any well known method, such as by interposing an imagewise mask in the beam of radiation or by modulating the output of the laser diode in accordance with imagewise information contained in a stream of electronic signals by well known means.

The following Example is presented to further illustrate a preferred mode of practice of the method of the invention.

EXAMPLE

An electrophotographic element was prepared having the following structure.

A poly(ethylene terephthalate) substrate was overcoated with a conductive layer comprising cuprous iodide and a polymeric binder. The conductive layer was overcoated with a photoconductive layer containing, in a polymeric binder, a photoconductive material having the structure:

and a near-infrared sensitizer comprising 2-(2-(2-chloro-3-(2-(1-methyl-3,3-dimethyl-5-nitro-3H-indol-2-ylidene)ethylidene)-1-cyclohexen-1-yl)ethenyl)-1-methyl-3,3-dimethyl-5-nitro-3H-indolium hexafluorophosphate. The ratio of photoconductor/sensitizer/binder by weight was 48/1/160. The photoconductive layer was overcoated with a releasable dielectric support comprising 16 parts by weight poly(vinyl acetate) and 4 parts by weight cellulose acetate butyrate. A release fluid was also included in the photoconductive layer to aid in later stripping the dielectric support from the rest of the element.

The outer surface of the dielectric support was charged to +500 volts and subjected, through a half-tone screen, to an imagewise exposure of actinic radiation having a wavelength of 830 nm. The imagewise exposure was effected by an AlGaAs laser diode in a scanning apparatus as described in copending U.S. patent application Ser. No. 848,427, filed Apr. 4, 1986, the disclosure of which has been incorporated herein by reference. The laser diode output intensity was modulated imagewise, electronically, corresponding to a black image desired to be produced. The scanning density was 71 scan lines per mm.

The resultant electrostatic latent image was developed electrophoretically with a liquid developer comprising toner particles of the black colorant, 1,4-bis(o-anisylazo)-2,3-naphthalenediol, and polyester toner binder (of the type described in U.S. Pat. No. 4,202,785), dispersed in the electrically insulating organic carrier liquid, Isopar G TM (a volatile isoparaffinic hydrocarbon having a boiling point range from about 145° to 185° C., trademarked by and available from Exxon Corporation, USA). The resultant black toner image on the dielectric support had a truly black appearance, having density of at least 0.24 to light of any wavelength within the visible spectrum and having density of less than 0.07 to radiation at the near-infrared wavelength of 830 nm.

Any remaining charge on the dielectric support was then erased by exposure of the electrophotographic element to wide-spectrum radiation. The outer surface of the dielectric support and black toner image was then uniformly recharged to +500 volts and exposed to the scanning laser radiation as in the first imaging cycle, except that in this case the laser diode output intensity was modulated imagewise, electronically, corresponding to a yellow image desired to be produced in registration with the black image, and had to pass through the black toner image in some surface areas in order to reach the electrophotographic element.

The resultant electrostatic latent image was developed electrophoretically with a liquid developer as in the first imaging cycle, except that, instead of the black colorant, a yellow colorant having the structure:

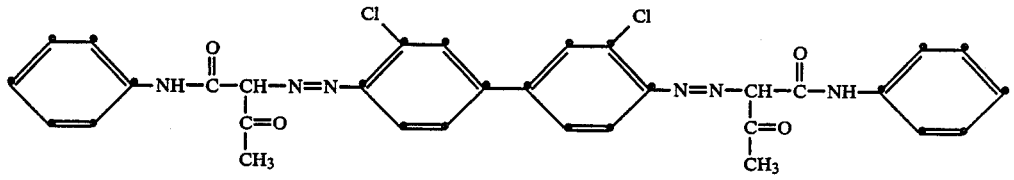

VIII was included in the toner particles. The resulting yellow toner image overlapped the black toner image on the dielectric support and exhibited no false imaging.

The composite black and yellow toner image had density of at least 0.27 to light of any wavelength within the visible spectrum and had density of less than 0.09 to radiation at the near-infrared wavelength of 830 nm.

The outer surface of the dielectric support and composite black and yellow toner image was then charge-erased, uniformly recharged to +500 volts, and exposed to the scanning laser radiation as in the previous imaging cycles; except that the laser diode output intensity was modulated imagewise, electronically, corresponding to a magenta image desired to be produced in registration with the composite black and yellow image, and had to pass through the overlapping black and yellow toner images in some surface areas in order to reach the electrophotographic element.

The resultant electrostatic latent image was developed electrophoretically with a liquid developer as in the previous imaging cycles, except that the colorant included in the toner particles was a magenta colorant having the structure:

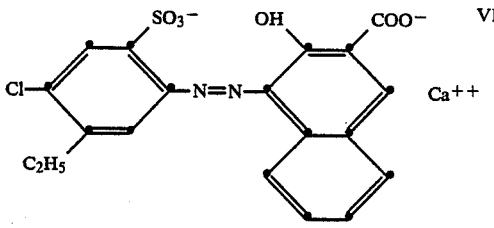

VII

The resulting magenta toner image overlapped the black and yellow toner images on the dielectric support and exhibited no false imaging. The composite of overlapping black, yellow, and magenta toner images had density of at least 0.3 to light of any wavelength within the visible spectrum and had density of less than 0.11 to radiation at the near-infrared wavelength of 830 nm.

The outer surface of the dielectric support and composite black, yellow, and magenta toner image was then charge-erased, uniformly recharged to +500 volts, and exposed to the scanning laser radiation as in the previous imaging cycles; except that the laser diode output intensity was modulated imagewise, electronically, corresponding to a cyan image desired to be produced in registration with the composite black, yellow, and magenta image, and had to pass through the overlapping black, yellow, and magenta toner images in some surface areas in order to reach the electrophotographic element.

The resultant electrostatic latent image was developed electrophoretically with a liquid developer as in the previous imaging cyles, except that the colorant included in the toner particles was a cyan colorant having the structure:

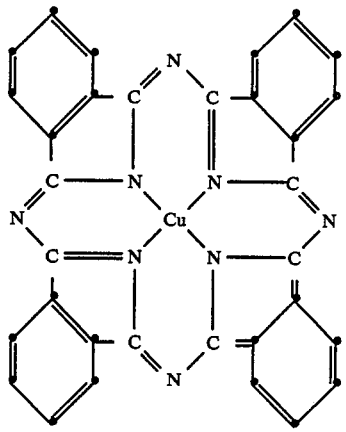

VI

The resulting cyan toner image overlapped the black, yellow, and magenta images on the dielectric support and exhibited no false imaging.

The electrophotographic element bearing the multicolor toner image was then moved to a separate lamination device comprising heated metal and rubber rolls, together forming a nip. The electrophotographic element was passed through the nip along with a white receiver paper against which the toner image-bearing dielectric support surface was pressed, at a roll temperature of 103° C. and a pressure of 225 pounds per square inch (1.551 MPa) to effect lamination of the dielectric support and composite image to the receiver followed by peeling off the rest of the electrophotographic element. The result was a multi-color toner image sandwiched between a white paper background and the dielectric support.

ALTERNATIVE EMBODIMENTS

While the preferred embodiment discloses apparatus employing a linear path for the platen carrying the electrophotographic element past the various stations, it will be appreciated that the present invention is equally applicable to apparatus wherein the electrophotographic element is mounted on a rotating drum for relative movement past the respective stations. Similarly, the electrophotographic element may be mounted on a stationary platen, with the stations being moved therepast in operative relationship thereto.

It will also be appreciated that the exposure station may employ a separation negative to provide the desired exposure of the electrophotographic element so long as the negative has the requisite density to the exposure light which must have a wavelength outside the visible spectrum, as noted above.

Although the invention has been described in detail with particular reference to certain preferred embodiments thereof, it should be appreciated that variations and modifications can be effected within the spirit and scope of the invention.

What is claimed is:

1. Electrophotographic apparatus for forming a subsequent toner image overlapping one or more toner images previously formed on a surface of an electrophotographic element, said apparatus comprising:

means for electrically charging said surface and said previously formed toner image or images, means for forming an electrostatic latent image overlapping the previously formed toner image or images on the surface by imagewise exposing the element, through the previously formed toner image or images, to actinic radiation of a wavelength outside the range of 400 to 700 nanometers; said previously formed toner image or images having a density of less than 0.2 to said actinic radiation, and means for electrographically developing the electrostatic latent image to thereby form the subsequent toner image.

2. The invention according to claim 1 wherein said means for generating said latent image includes means for exposing said element to a scanning beam of light.

3. The invention according to claim 2 wherein said beam of light is produced by a laser having an output radiation of a wavelength outside the range of 400 to 700 nanometers.

4. The invention according to claim 3 wherein the wavelength of the output radiation is greater than 700 nanometers and less than or equal to 1000 nanometers.

5. The invention according to claim 1 wherein said means for electrographically developing the electrostatic image includes at least one means for applying a liquid electrographic developer.

6. Electrophotographic apparatus for forming a composite toner image on a surface of a charged electrophotographic element which is sensitive to a predetermined wavelength of actinic radiation outside the visible spectrum and wherein said toner image is formed of preselected toner materials having a density of less than 0.2 to such actinic radiation, said apparatus comprising:

means for providing relative motion between an electrophotographic element and successive charging, exposing, and developing stations;

means at the charging station for electrically charging said electrophotographic element;

means at the exposure station for generating actinic radiation having said predetermined wavelength to expose the electrophotographic element to form an electrostatic latent image on said electrophotographic element;

means at the developing station for developing said electrostatic latent image with one of said preselected toner materials; and means for repeating the relative motion between said electrophotographic element bearing a developed image and said stations for charging and exposing the electrophotographic element through the developed image to form an additional latent electrostatic image on the electrophotographic element and for developing said additional image using another of said preselected toner materials to produce a composite image formed of at least two toner materials on the electrophotographic element.

7. The invention according to claim 6 wherein said means for generating said latent image includes means for exposing said element to a scanning beam of light.

8. The invention according to claim 7 wherein said beam of light is produced by a laser having an output radiation of a wavelength outside the range of 400 to 700 nanometers.

9. The invention according to claim 8 wherein the wavelength of the output radiation is greater than 700 nanometers and less than or equal to 1000 nanometers.

10. The invention according to claim 6 wherein said means for electrographically developing the electrostatic image includes at least one means for applying a liquid electrographic developer.

* * * * *